United States Patent [19]

Evans et al.

[11] Patent Number: 4,941,822

[45] Date of Patent: Jul. 17, 1990

[54] APPARATUS FOR HEAT TREATING CONTAMINATED PARTICULATE MATERIAL

[76] Inventors: Marvin Evans, 8550 N. Fielding Rd.; David H. Miller, 610 E. Birch Ave., both of Milwaukee, Wis. 53217

[21] Appl. No.: 382,228

[22] Filed: Jul. 20, 1989

[51] Int. Cl.[5] ..... F27B 7/08

[52] U.S. Cl. ..... 432/112; 432/117; 432/109

[58] Field of Search ..... 432/103, 107, 109, 112, 432/117; 110/246, 276

[56] References Cited

U.S. PATENT DOCUMENTS

| | | | |
|---|---|---|---|
| 2,348,673 | 5/1944 | Degner | 432/112 |
| 3,813,210 | 5/1974 | Miskolczy et al. | 432/109 |
| 4,191,530 | 3/1980 | Bearce | 432/107 |
| 4,200,262 | 4/1980 | Evans et al. | 266/44 |
| 4,201,370 | 5/1980 | Evans et al. | 266/44 |
| 4,245,983 | 1/1981 | Lindroos | 432/117 |
| 4,337,929 | 7/1982 | Evans | 266/248 |
| 4,684,342 | 8/1987 | Harcuba | 432/112 |
| 4,813,784 | 3/1989 | Musil | 432/117 |
| 4,834,647 | 5/1989 | Key | 432/154 |

OTHER PUBLICATIONS

Coreco, Mini-Model 1224 Sand Reclaimer, 9/87.

*Primary Examiner*—Henry C. Yuen

*Attorney, Agent, or Firm*—Andrus, Sceales, Starke & Sawall

[57] ABSTRACT

An apparatus for heat treating contaminated particulate material and more particularly, an apparatus for reclaiming foundry sand. The apparatus includes a heated, inclined rotary drum and an auger projects into the upstream end of the drum and serves to feed material to the drum. The auger includes a spiral flight carried by a hollow shaft and a blower is connected to the outer end of the hollow shaft so that air is supplied through the shaft into the drum. A seal is provided between the non-rotating auger housing and the drum, and the seal includes an annular bearing plate mounted on the end of the drum while a sealing ring is connected to the auger housing and is biased against the plate to provide a seal. The excess air in the heated drum burns off the organic contaminates from the particulate material and calcines the mineral contaminates. The treated particulate material is transferred from the downstream end of the drum to a second cooling drum and air is passed through the second drum countercurrently to movement of the particulate material to cool the material.

21 Claims, 2 Drawing Sheets

APPARATUS FOR HEAT TREATING CONTAMINATED PARTICULATE MATERIAL

BACKGROUND OF THE INVENTION

Waste foundry sand contains a binder, such as clay or organic binders such as furan, urethane and the like. The disposal of foundry sand has become a serious problem. Solid waste disposal sites are disappearing and the cost of shipping the foundry sand has increased. Further, on-site disposal is not an alternative because of the environmental regulations and, in most instances, the lack of adequate space for on-site disposal.

Because of this, waste foundry sand reclamation systems have been proposed. In one system the waste foundry sand is fed into the upper end of an inclined rotary drum and air is supplied to the down-stream end of the drum and flows countercurrently to the flow of the sand. Heat is applied to the external surface of the drum to heat the sand to a temperature in the range of about 1200°-1600° F. The heating in the presence of oxygen acts to burn the organic materials from the sand and calcine the mineral additives.

In the reclamation system, as used in the past, the treated sand is discharged from the low end of the inclined drum and flows through a chute to a cooling drum where air is passed countercurrently to the flow of sand to cool the sand. The sand discharged from the cooling drum then passes through a sand scrubber and classifier to remove the fines from the reclaimed sand.

In the prior reclamation systems, the gases discharged from the upstream end of the drum are not completely combusted. Therefore, an afterburner is employed to receive the gases from the upper end of the inclined drum and provide complete combustion of the combustibles. The afterburner is costly and can contribute up to 40% of the overall cost of the reclamation system.

SUMMARY OF THE INVENTION

The invention is directed to an improved apparatus for heat treating contaminated particulate material, such as foundry sand. The apparatus includes an inclined rotary drum, and an auger projects into the upstream end of the drum and serves to feed the sand or other contaminated particulate material into the drum.

The auger includes a hollow shaft which carries a spiral flight and a blower is connected to the outer end of the shaft and acts to supply air through the shaft into the rotary drum. The flow of air into the drum is controlled by a valve in the air line which connects the blower to the shaft. The air is supplied in a quantity in excess of that required to completely burn the organic materials from the sand and calcine the mineral contaminates.

As the auger housing is fixed while the drum is rotating, a seal is provided between the auger housing and the drum. The seal includes an annular bearing plate which is mounted on the upstream end of the inclined drum and a sealing ring is connected to the auger housing and is biased against the bearing plate to provide a seal.

The drum is heated externally by a plurality of fuel burners.

The sand is discharged from the lower downstream end of the rotary drum and is transferred through a chute to an inclined cooling drum. Air is passed through the cooling drum in countercurrent relation to the flow of the sand to thereby cool the sand.

The sand being discharged from the cooling drum is discharged to a sand scrubber and then passes to a classifier which remove the fines from the treated sand. The reclaimed sand can then be reused in foundry practice.

The apparatus of the invention provides a complete combustion of the organic materials in the primary drum so that no afterburner is required in the system. By eliminating the need of an afterburner, the overall capital and operating cost of the reclamation system is substantially reduced.

With the system of invention there is no direct flame impingement on the sand grains, with the result that there is no surface fusion of foreign materials onto the grains which would alter the surface of the sand and possibly interfere with re-bonding operations.

The apparatus of the invention can be used with sand containing either organic or clay binder contaminates and will achieve the complete removal of the contaminates.

The apparatus of the invention also has reduced air volume requirements over prior systems.

The invention is more energy efficient than prior processes in that all of the organics are burned from the sand and contribute to the overall fuel requirements of the system.

Other objects and advantages will appear in the course of the following description.

DESCRIPTION OF THE ILLUSTRATED EMBODIMENT

Figure 1:
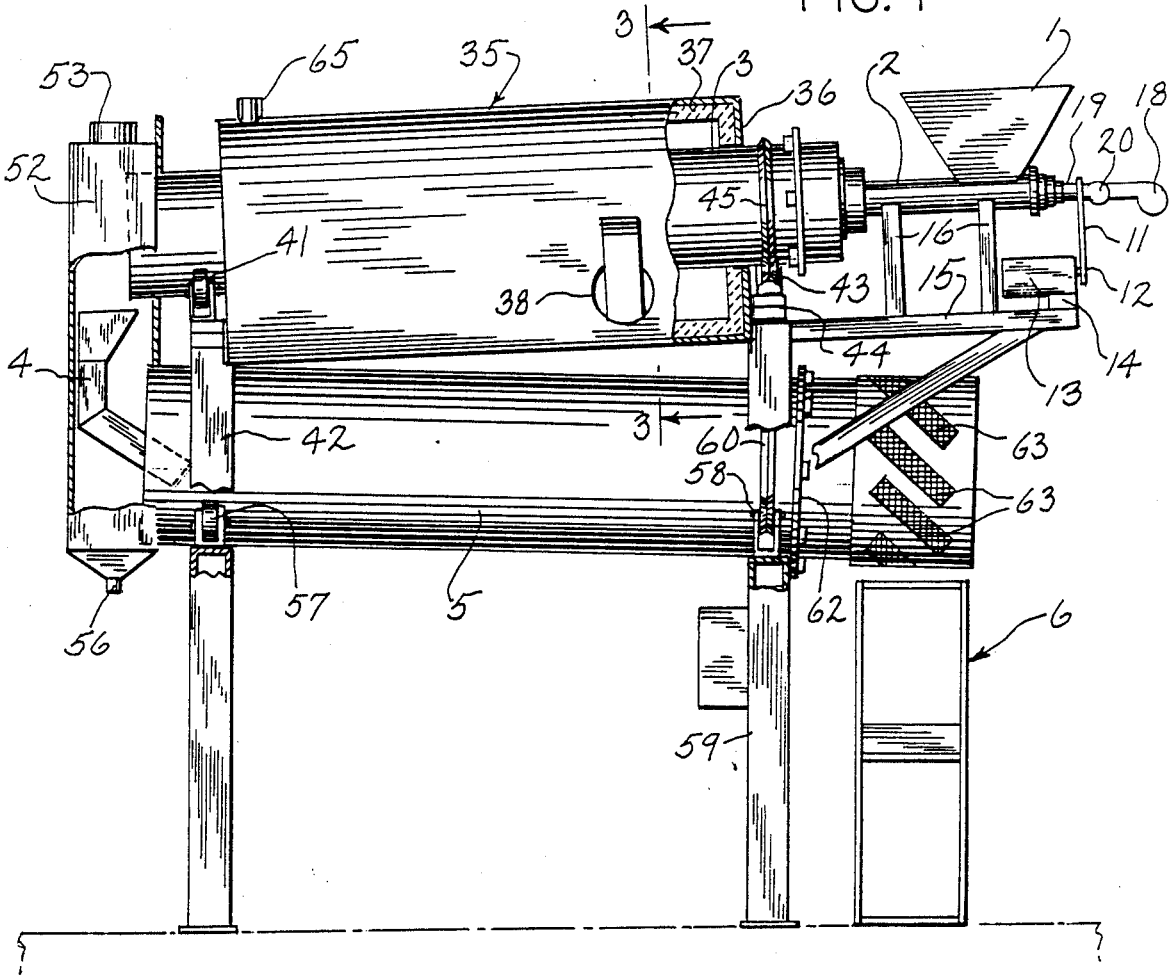
FIG. 1 is a side elevation of the apparatus of the invention with parts broken away in section.
Figure 3:
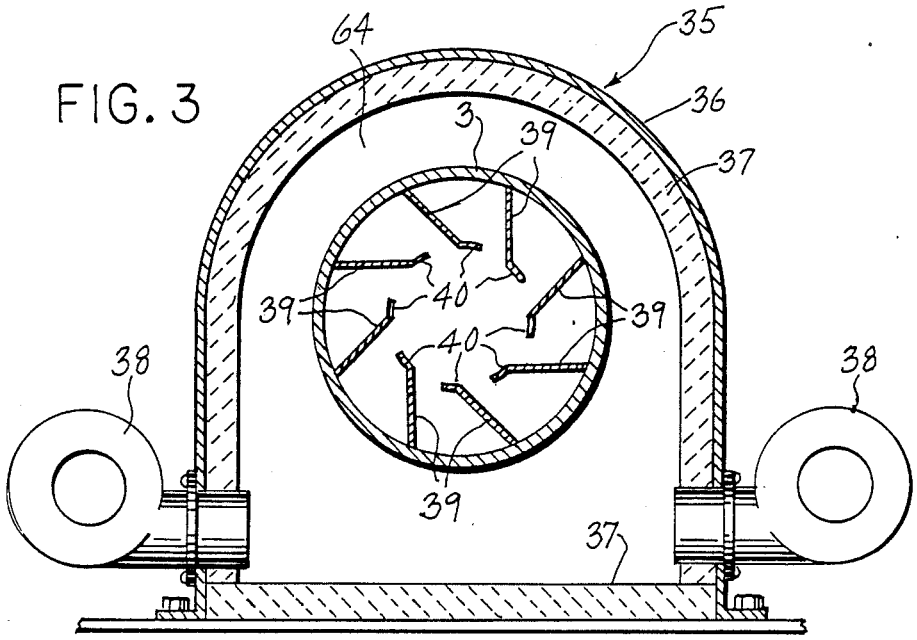
FIG. 3 is a section taken along line 3—3 of FIG. 1.
Figure 2:
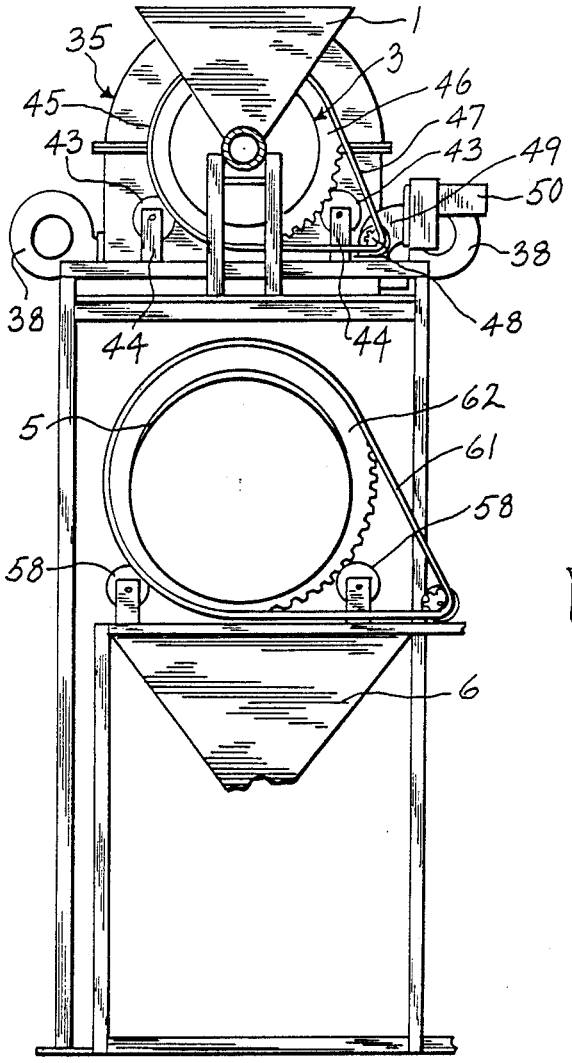
FIG. 2 is an end view of the apparatus.

The drawings illustrate an apparatus for heat treating a contaminated particulate material and has particular application for treating foundry sand containing either an organic or mineral contaminate.

In general, the apparatus includes a hopper 1 through which the particulate material is delivered to an auger 2. The auger in turn feeds the particulate material to the upstream end of an inclined rotary calcining drum 3. The treated material being discharged from the lower end of drum 3 is conveyed via a transfer chute 4 to the upstream end of an inclined rotary cooling drum 5 which is located beneath the calcining drum 3. The cooled material is then discharged from drum 5 to a collection site indicated generally by 6.

Auger 2 includes a spiral flight 7 mounted on a hollow shaft 8 and the flight rotates within an outer fixed housing 9.

To rotate the shaft 8, a sprocket 10 is secured to the outer end of the shaft and is connected via a chain 11 to a sprocket 12 mounted on the output shaft of a gearbox 13 which is driven by motor 14. Gearbox 13 is mounted from the frame 15 of the machine, while a series of upright frame supports 16 serve to support the auger housing 7.

With this construction, operation of motor 14 will drive flight 7 and convey the particulate material being fed through hopper 1 into the upstream end of the calcining drum 3.

The auger shaft 8 is journaled for rotation within a pair of bearings 17 which are mounted on the auger housing 9.

To supply air to the drum 3, the outlet of a blower 18 is connected through a conduit 19 to the outer end of the hollow auger shaft 8 and the flow of air through conduit 19 is controlled by a suitable valve 20 mounted in conduit 19.

Figure 4:
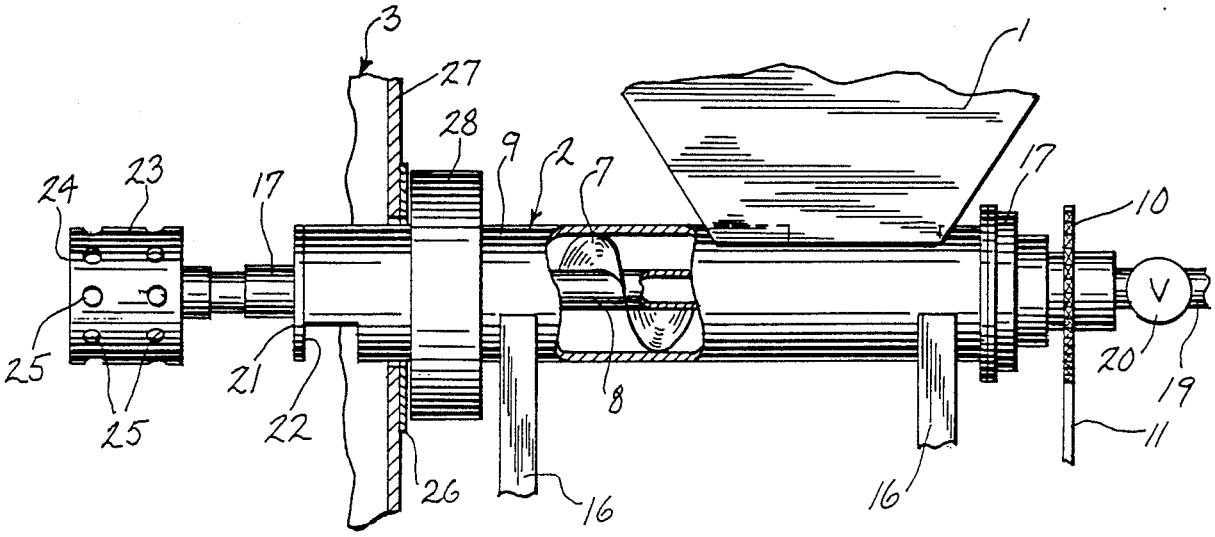
FIG. 4 is an enlarged fragmentary longitudinal section showing the connection of the auger to the rotary drum.

As best shown in FIG. 4, the inner end of auger housing 9 is closed, as indicated by 21, and the housing is provided with an arcuate opening 22 which is located in the lower portion of the housing adjacent closed end 21. The particulate material being conveyed through the housing 9 will be discharged through opening 22 into drum 3.

Mounted on the inner end of shaft 8 is a generally cylindrical diffuser 23. Diffuser 23 has a closed end 24 and the periphery of the diffuser is provided with a plurality of outlet ports 25 through which the air is discharged into drum 3.

Figure 5:
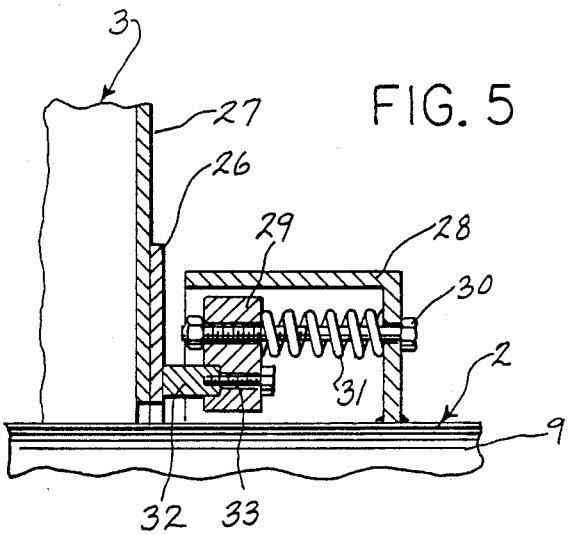
FIG. 5 is an enlarged fragmentary longitudinal section showing the details of the seal between the auger and the drum.

As drum 3 is adapted to rotate relative to the fixed auger housing 9, a seal is provided between the auger housing and the drum, as best seen in FIG. 5. In this regard an annular plate 26 is mounted on the end wall 27 of drum 3 and borders the auger housing 9. A cup shaped member 28 is secured to the outer surface of housing 9 and a support ring 29 is located within member 28 and is connected to member 28 by a plurality of circumferentially spaced bolts 30. Springs 31 surround bolts 30 and are interposed between support ring 29 and the inner surface of the cup shaped member 28 and act to urge the support ring 29 toward end wall 27 of drum 3.

A sealing ring 32 formed of a material, such as brass, is mounted within a circumferential recess in support ring 29 and is secured within the recess by a plurality of screws 33. The springs 31 act to urge the sealing ring 32 against the annular plate 26 to thereby provide a seal between the fixed auger housing 7 and the rotating drum 3.

Drum 3 is heated externally and in this regard an outer housing 35 is spaced around drum 3 and housing 35 includes an outer steel shell 36 and an inner refractory liner 37. A plurality of fuel burners 38 are mounted within openings in housing 35 and the outlets of the burners are located in the space between the refractory liner 37 and the drum 3. The heating requirements generally depend on the nature of the material being treated, but in practice the sand or particulate material is normally heated to a temperature in the range of about 1200°-1600° F.

Located within drum 3 are a plurality of longitudinal baffles 39 having bent ends 40. As drum 3 rotates the baffles 39 tend to engage and lift the sand or particulate material to provide more uniform heating and expose all of the sand grains to the flow of air passing through the drum.

To rotate drum 3, a pair of idler rollers 41 are mounted on frame members 42 and act to support the lower or downstream end of drum 3 for rotation. In addition, a second pair of grooved rollers 43 are journaled on frame members 44 and engage a circumferential track 45 that is mounted on the upstream end of drum 3. Rollers 43 are driven by a chain drive consisting of a sprocket 46 that is secured to the outer surface of drum 3 adjacent track 45 and sprocket 46 is connected through chain 47 to a sprocket 48 mounted on the output shaft of gearbox 49 which is driven by motor 50. Gearbox 49 and motor 50 are supported on frame 15. With the drive connection, operation of motor 50 will rotate drum 3 generally at a rate of 0.25 to 4.0 rpm. The inclined attitude of the drum 3, in combination with rotation, will move the particulate material within the drum to the lower or downstream end.

A housing 52 is mounted around the downstream end of drum 3 and the upper end of housing 52 is provided with a vent 53 which acts to vent the gases as will be hereafter described.

The sand or particulate material being discharged from the downstream end of drum 3 is conveyed through chute 4 to the upper end of inclined cooling drum 5 which is mounted beneath drum 3. The lower end of housing 52 is provided with an outlet 56 from which fines and dust can be removed from the housing.

Drum 5 can be with a plurality of longitudinal baffles, not shown which are similar in construction to baffles 39.

The up stream end of drum 5 is mounted for rotation on a pair of idler rollers 57 mounted on frame members 42 and on a second pair of rollers 58 that are mounted on frame members 59 and ride on V-track 60 secured to outer surface of drum 5. To rotate drum 5, a chain drive 61 is utilized which is connected to sprocket 62 on drum 5. The chain drive is similar in construction to the chain drive previously described that is employed to rotate drum 3.

Rotation of drum 5 along with the action of the internal baffles will move the particulate material through the drum 5 where the material is discharged through a series of screens 63 which are spaced around the circumference of the drum. The sand or particulate material passes through the screens 63 and is discharged to site 6. In practice, the treated sand is delivered to a sand scrubber where foreign material and dead clay are removed pneumatically from the sand grains. The scrubbed sand then is conveyed to an air classifier to remove fines and foreign material. The resulting processed sand can then be re-used in sand casting operations.

Larger size material which will not pass through screens 63 is discharged from the open down-stream end of drum 5 to a suitable collection container, not shown.

The apparatus of the invention can be used to reclaim clay bonded sand or sand containing organic binders. In operation the sand is initially treated to breakup larger size lumps and the delumped sand is then fed to the hopper 1 and conveyed by the auger 2 into the rotating incline drum 3. The auger feeds the waste sand at a uniform rate into the drum where the sand is heated to a preselected temperature in the range of 1200°-1600° F., with the particular temperature depending upon the process cycle required to burn out the organic content and calcine the mineral contaminates.

Air is supplied by the blower 18, generally at a volume of 100 to 200 cubic feet per minute, and the amount of air required is adjusted to provide 100 percent excess oxygen for the required demand. The drum 3 thus acts as an afterburner where the gases are retained at the elevated temperature for sufficient time to allow complete combustion to take place prior to their exit into the housing 52.

The heated sand exits from the drum 3 and drops through chute 54 into the rotary cooler drum 5 where it is cascaded repeatedly by the internal baffles and is exposed to a counterflow induced draft airstream with the air entering the open downstream end of the drum. The sand exits the drum 5 at near ambient temperature and is discharged through the rotary screens 63. Oversized foreign material is discharged through the open downstream end of drum 5.

Vent 53 in housing 52 can be connected to a conventional cyclone/bag house dust collecting system. The dust and fines separated from the treated sand, along with the process gases from the drum 3, flow through the vent 53 to the cyclone/bag house dust collecting system that acts in a conventional manner to remove the balance of the fines from the gases.

The waste combustion gases from fuel burners 38 are discharged from space 64 between drum 3 and housing 35 through outlet 65 to the atmosphere.

The system of the invention can be used to reclaim foundry sand containing either mineral contaminates, such as clay, or organic binders. The indirect heating system with the controlled air flow results in the complete combustion of the organic contaminates and complete calcining of the minerals so that no after-burner is required. By eliminating the need for an afterburner, the overall cost of the reclaiming system is substantially reduced.

The system is also more energy efficient than those systems used in the past in that all of the organic materials are combusted in the drum or retort, and contribute to the overall fuel requirements for the system.

While the above description has illustrated the systenm as used to remove contaminates from foundry sand, it is contemplated that the system can be used to treat other types of particulate material, such as the removal of oil contaminates from soil, the controlled incineration of sewage sludge, and other waste materials, and the like.

Various modes of carrying out the invention are contemplated as being within the scope of the following claims particularly pointing out and distinctly claiming the subject matter which is regarded as the invention.

We claim:

1. An apparatus for heat treating particulate material, comprising a rotary drum having an upstream end and a downstream end, first drive means for rotating said drum, auger means including a cylindrical housing communicating with the upstream end of said drum, said auger means also including a rotatable hollow shaft and a spiral flight mounted on said shaft, feeding means associated with said auger means for feeding a particulate material to said auger means, second drive means for rotating said spiral flight to convey said material through said housing and into said drum, heating means for heating the external surface of the drum, air supply means connected to said hollow shaft for introducing air through said shaft to said drum, and sealing means for sealing said housing to said drum to prevent the escape of gas at the joint between the rotating drum and said housing.

2. The apparatus of claim 1, wherein said drum is inclined downwardly in a direction from the upstream end to said downstream end.

3. The apparatus of claim 2, and including baffle means disposed within said drum for cascading said material within the drum.

4. The apparatus of claim 1, and including a refractory housing spaced outwardly of said drum to provide a space therebetween, said heating means comprising at least one fuel burner disposed within said space.

5. The apparatus of claim 1, wherein said feeding means comprises a hopper communicating with the interior of said auger housing.

6. The apparatus of claim 1, wherein said air supply means comprises a blower connected to the outer end of said shaft.

7. The apparatus of claim 6, and including diffuser means mounted on the inner end of said shaft and disposed within said drum for diffusing the air being discharged from said shaft.

8. The apparatus of claim 7, wherein said diffuser means comprises a generally cylindrical diffuser member having an end wall disposed normal to the axis of said shaft, said diffuser member also having a generally cylindrical peripheral wall, and outlet port means disposed in said peripheral wall.

9. The apparatus of claim 6, and including flow control means for controlling the flow of air supplied by said blower to said shaft.

10. The apparatus of claim 1, and including a second inclined rotary drum, transfer means for transferring the material from the downstream end of said first drum to an upstream end of said second drum, and collection means located at the downstream end of said second drum for collecting said material being discharged from said downstream end.

11. The apparatus of claim 10, including means for flowing air through said second drum in a countercurrent direction with respect to the flow of material through said second drum.

12. The apparatus of claim 1, wherein the downstream end of said auger housing is closed and the lower portion of said auger housing has an opening adjacent said closed end for discharge of said material from said housing to said drum.

13. An apparatus for heat treating contaminated particulate material, comprising a rotary inclined drum having an upstream end and a downstream end, first drive means for rotating said drum, auger means including a cylindrical auger housing communicating with the upstream end of said drum, said auger means also including a hollow central shaft and a spiral flight connected to said shaft, the inner end of said shaft communicating with said drum, feeding means associated with said auger means for feeding a particulate contaminated material to said auger means, second drive means for rotating said shaft to thereby convey the material through said auger means to said drum, heating means for heating the external surface of said drum to thereby heat the material passing through said drum, a blower connected to the outer end of said hollow shaft for supplying air to said shaft, said air passing through said shaft and into said drum, and sealing means for sealing the auger housing with respect to the upstream end of said drum to thereby prevent the escape of gas through the joint between said auger housing and said drum.

14. The apparatus of claim 13, wherein said sealing means comprises a sealing ring connected to said auger housing and disposed radially outward of said housing, said sealing ring disposed in engagement with an end wall of said drum.

15. The apparatus of claim 14, and including biasing means for urging the sealing ring against said end wall.

16. The apparatus of claim 15, wherein said sealing means also includes a support ring disposed concentrically outward of said housing, said sealing ring being removably mounted on said support ring, said biasing means interconnecting said support ring and said housing.

17. An apparatus for heat treating contaminated particulate material, comprising a rotary drum having an upstream end and a downstream end, first drive means for rotating said drum, auger means for feeding a particulate material to said drum and including a cylindrical housing, said auger means also including a rotatable hollow shaft and a spiral flight mounted on said shaft, feeding means associated with one end of said auger means for feeding a particulate material to said auger means, the opposite end of said auger means disposed in said drum, second drive means for rotating said spiral flight to convey said material into said drum, heating means for heating the external surface of the drum, air supply means connected to said hollow shaft for introducing air through said shaft to said drum, sealing means for sealing said housing to said drum to prevent the escape of gas at the joint between the rotating drum and said housing, and gas discharge means disposed at the downstream end of said drum for discharging gases exiting from said drum.

18. The apparatus of claim 17, and including a second inclined rotary drum disposed beneath said first drum, transfer means for transferring the material being discharged from the downstream end of said first drum to an upstream end of said second drum, and collection means located at the downstream of said second drum for collecting the material being discharged from said the downstream end of said second drum.

19. The apparatus of claim 18, and including means for flowing air through the second drum in a direction from said downstream end to said upstream end.

20. The apparatus of claim 19, and including means disposed at the downstream end of said second drum for separating larger sized material from smaller sized material.

21. The apparatus of claim 18, wherein said transfer means comprises a chute.

* * * * *